US011337528B2

(12) United States Patent
Oh et al.

(10) Patent No.: US 11,337,528 B2
(45) Date of Patent: May 24, 2022

(54) DRYER FOR BED

(71) Applicant: LG ELECTRONICS INC., Seoul (KR)

(72) Inventors: Minkyu Oh, Seoul (KR); Yanghwan No, Seoul (KR); Jaemyung Lim, Seoul (KR); Hyunshin Kee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 109 days.

(21) Appl. No.: 16/682,605

(22) Filed: Nov. 13, 2019

(65) Prior Publication Data

US 2020/0170418 A1 Jun. 4, 2020

(30) Foreign Application Priority Data

Dec. 4, 2018 (KR) ..... 10-2018-0154226

(51) Int. Cl.
*A47C 21/04* (2006.01)
*F26B 21/00* (2006.01)
*A47C 17/86* (2006.01)

(52) U.S. Cl.
CPC ..... *A47C 21/048* (2013.01); *A47C 21/044* (2013.01); *A47C 17/86* (2013.01); *A47C 21/04* (2013.01); *F26B 21/001* (2013.01); *F26B 21/004* (2013.01)

(58) Field of Classification Search
CPC ..... A47C 21/048; A47C 21/04; A47C 21/042; A47C 21/046; A47C 21/044; A47C 31/007; A47C 17/86; F26B 21/004; F26B 21/001
See application file for complete search history.

(56) References Cited

U.S. PATENT DOCUMENTS 10,342,358 B1 * 7/2019 Palashewski ..... A47C 27/083
2008/0148481 A1 * 6/2008 Brykalski ..... A47C 21/048 5/423
2009/0064411 A1 * 3/2009 Marquette ..... B60H 1/00742 5/423
2010/0011502 A1 * 1/2010 Brykalski ..... A47C 21/04 5/423
2011/0107514 A1 * 5/2011 Brykalski ..... A47C 21/044 5/421
2011/0115635 A1 * 5/2011 Petrovski ..... A61G 7/05 340/584
2013/0269106 A1 * 10/2013 Brykalski ..... A47C 7/744 5/423
2014/0201909 A1 * 7/2014 Weyl ..... A61G 7/05715 5/423
2015/0272338 A1 * 10/2015 Greener ..... A47C 21/024 5/423

(Continued)

FOREIGN PATENT DOCUMENTS

CN 1510368 A 7/2004
CN 102865719 A 1/2013

(Continued)

*Primary Examiner* — Peter M. Cuomo
*Assistant Examiner* — Morgan J McClure
(74) *Attorney, Agent, or Firm* — Dentons US LLP

(57) ABSTRACT

A dryer for a bed includes an air blowing device provided at a front portion or a rear portion of a frame and supplying hot air, so that a mattress may be easily dried or articles kept in a drawer may be easily dried.

18 Claims, 18 Drawing Sheets

(56) References Cited

U.S. PATENT DOCUMENTS

| | | | | |
|---|---|---|---|---|
| 2016/0115684 | A1* | 4/2016 | Joynson | E04B 1/7092 34/241 |
| 2017/0191684 | A1* | 7/2017 | Tompkins | A47C 21/044 |
| 2017/0360212 | A1* | 12/2017 | Rawls-Meehan | A47C 19/025 |
| 2018/0070722 | A1* | 3/2018 | Yang | A47K 10/48 |
| 2018/0160819 | A1* | 6/2018 | Rutledge | A47C 21/003 |
| 2019/0320808 | A1* | 10/2019 | Chapin | A47C 27/144 |
| 2019/0335913 | A1* | 11/2019 | Tsern | A47C 21/048 |
| 2020/0037777 | A1* | 2/2020 | Kotelmach | F04D 17/16 |

FOREIGN PATENT DOCUMENTS

| | | | | | |
|---|---|---|---|---|---|
| CN | 203928601 | U | | 11/2014 | |
| EP | 0203059 | A2 | | 11/1986 | |
| FR | WO 2007060371 | | * | 5/2007 | A47C 21/044 |
| KR | 10-20002-0088793 | A | | 11/2002 | |
| WO | 2007/060371 | A2 | | 5/2007 | |
| WO | 2013/081280 | A1 | | 6/2013 | |
| WO | 2014/106119 | A1 | | 7/2014 | |

* cited by examiner

DRYER FOR BED

CROSS-REFERENCE TO RELATED APPLICATIONS

This application claims the benefit of the Korean Patent Application No. 10-2018-0154226 filed on Dec. 4, 2018, which is hereby incorporated by reference as if fully set forth herein.

BACKGROUND

Field of the Disclosure

The present disclosure relates to a dryer for a bed.

Discussion of the Related Art

Recently, it is common for each home to have a bed. In order to ensure a comfortable bed time, interest in hygienic care of beds has increased in line with an increase in functional requirements of beds.

In particular, a mattress of a bed may be easily contaminated due to user's sweat or dust at home. In addition, harmful organisms such as bacteria or mites or germs that may inhabit the mattress due to the contamination may threaten user's health.

Therefore, users use a professional bed care company to clean or sterilize the mattress of the bed in many cases. This, however, incurs high cost.

Korean Patent Laid-open Publication No. (Publication Date): 2002-0088793 (Nov. 29, 2002) discloses a device for restraining propagation of germs by supplying cold or warm air to a bed.

However, air generated by the warm air/cold air device does not circulate smoothly, causing loss of air pressure acting on the mattress.

Also, in a bed provided with a drawer, it is not easy to install the warm air/cold air device and it is not possible to dry clothes or blankets stored in the drawer.

SUMMARY

An aspect of the present disclosure is directed to providing a dryer for a bed, capable of preventing propagation of germs, mold or dust mites by performing drying on a mattress.

Another aspect of the present disclosure is directed to providing a dryer for a bed, capable of easily circulating air through a first air blowing device provided at a frame of the bed.

Another aspect of the present disclosure is directed to providing a dryer for a bed, capable of supplying warm air to the bottom of a mattress and discharging part of air to a lower space of the mattress by driving the first air blowing device.

Another aspect of the present disclosure is directed to providing a dryer for a bed, capable of easily circulating air through a second air blowing device provided at a drawer provided in the bed.

Another aspect of the present disclosure is directed to providing a dryer for a bed, capable of supplying warm air to an inside of a drawer and forming a circulation flow path of air outside the drawer according to driving of the second air blowing device.

Another aspect of the present disclosure is directed to providing a dryer for a bed, in which a fan and a heater of the first air blowing device or the second air blowing device are modularized to implement a device for supplying warm air to have a compact structure.

Another aspect of the present disclosure is directed to providing a dryer for a bed, in which an air blowing device includes an outlet vane and the outlet vane controls ON/OFF to change a circulation flow path of warm air, thereby selectively drying a mattress or an article kept in a drawer.

Another aspect of the present disclosure is directed to providing a dryer for a bed, in which drawers have flow path holes so that warm air may be circulated between the adjacent drawers.

To achieve these and other advantages and in accordance with the purpose of the disclosure, as embodied and broadly described herein, there is provided a dryer for a bed and a bed including an air blowing device provided at a front portion or a rear portion of a frame to supply warm air, whereby it is easy to dry a mattress or an article kept in a drawer.

A mattress drying flow path may be provided between a bottom of the mattress and a flow path plate and configured to allow air which passes through the air blowing device to flow therethrough, whereby warm air may be easily supplied to the bottom of the mattress.

The air blowing device may include an air blowing body forming an air outlet, a heater installed on an inner side of the air blowing body, and a fan configured to supply air heated by the heater to the mattress drying flow path.

The bed further includes a partitioning bracket provided in the frame and configured to partition an installation space of a drawer.

The flow path plate is supported on an upper side of the partitioning bracket, whereby it is easy to form the mattress drying flow path.

The air blowing device includes a first air blowing device disposed at a front portion of the frame and a second air blowing device disposed at a rear portion of the frame, whereby warm air may be easily generated.

The first air blowing device includes a first air blowing body coupled to an inner surface of the front portion of the frame, an air inlet provided at a lower portion of the first air blowing body, and a first air outlet provided at an upper portion of the first air blowing body.

A frame depressed portion forming a space in which the fan and the heater are installed is provided on the inner surface of the front portion of the frame, and the first air blowing body covers the frame depressed portion.

The fan includes a cross-flow fan.

The first air outlet includes a first outlet portion disposed on an upper side of the fan and a second outlet portion disposed on an upper side of the rear of the center of the fan.

The first outlet portion and the mattress drying flow path may communicate with each other.

The dryer further includes an outlet vane coupled to the first outlet portion, the outlet vane being configured to open and close the first outlet portion, whereby it is easy to control supply of air.

An output power of the heater when the outlet vane opens the first outlet portion is greater than an output power of the heater when the outlet vane closes the first outlet portion, whereby the mattress may be supplied with hot air and the drawer may be supplied with warm air.

The bed further includes a drawer provided to be drawn into or out of the frame, and a drawer flow path communicating with the second outlet portion is formed at an outer space of the drawer, whereby hot air supplied to the drawer may be easily circulated.

The bed further includes a first drawer provided to be drawn into or out from the rear of the frame, and the second air blowing device is installed at the drawer, whereby hot air may be easily supplied to the drawer.

The bed further includes a second drawer provided to be drawn into or out from a lateral side of the frame, and the second air blowing device is installed on a front side of the second drawer.

A plurality of heater brackets provided on a suction side of the fan, and the heater is supported by the plurality of heater brackets, whereby the heater may be easily supported.

The flow path plate is formed with a plate penetrating portion, and air flowing in the mattress drying flow path may flow to a lower side of the flow path plate through the plate penetrating portion.

The air blowing device further includes a flow guide coupled to an inner surface of the air blowing body and extending curvedly to an outer side of the fan.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION OF THE DISCLOSURE

Figure 1:
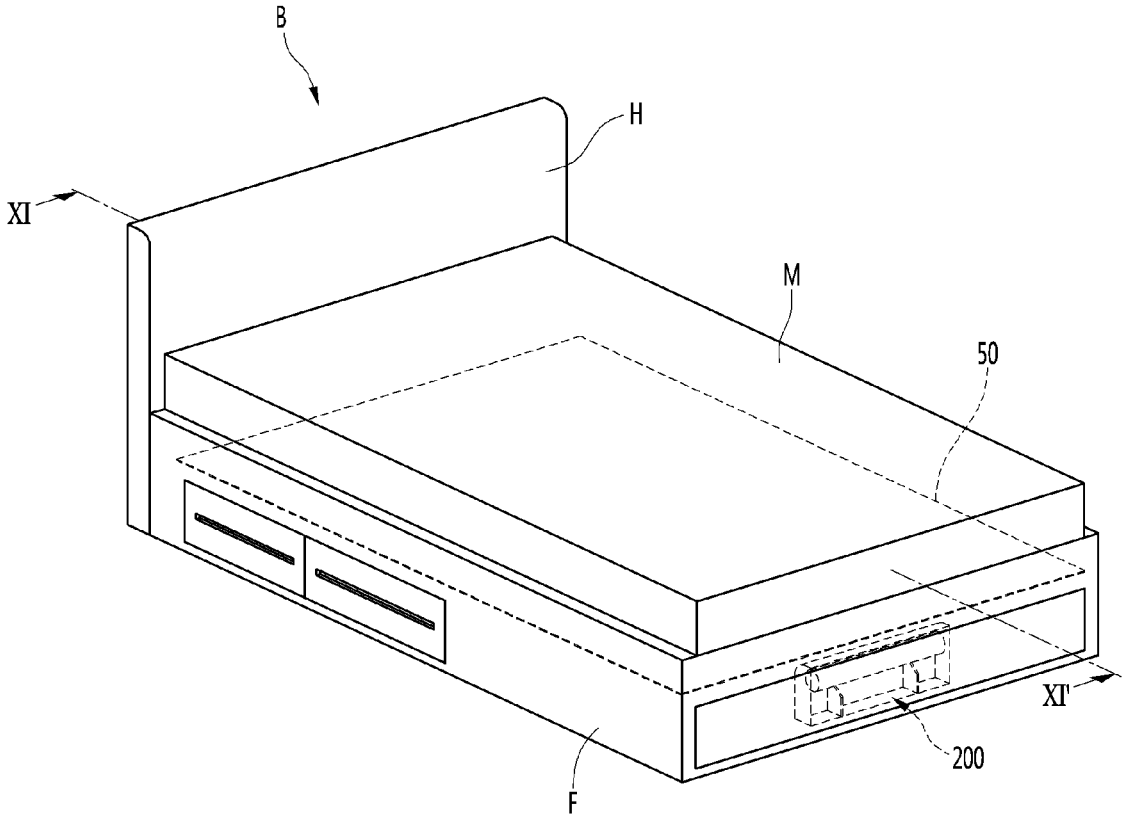
FIG. 1 is a perspective view showing a bed installed with a dryer according to an embodiment of the present disclosure.

Hereinafter, exemplary embodiments of the present disclosure will be described in detail with reference to the accompanying drawings. In adding reference numerals for elements in each figure, it should be noted that like reference numerals already used to denote like elements in other figures may be used for elements wherever possible. Moreover, detailed descriptions related to well-known functions or configurations may be omitted in order not to unnecessarily obscure subject matters of the present disclosure.

In describing the elements of the present disclosure, terms such as first, second, A, B, (a), (b), etc., may be used. Such terms are used for merely discriminating the corresponding elements from other elements and the corresponding elements are not limited in their essence, sequence, or precedence by the terms. It will be understood that when an element or layer is referred to as being "on" or "connected to" another element or layer, it may be directly on or directly connected to the other element or layer, or intervening elements or layers may be present.

Figure 2:
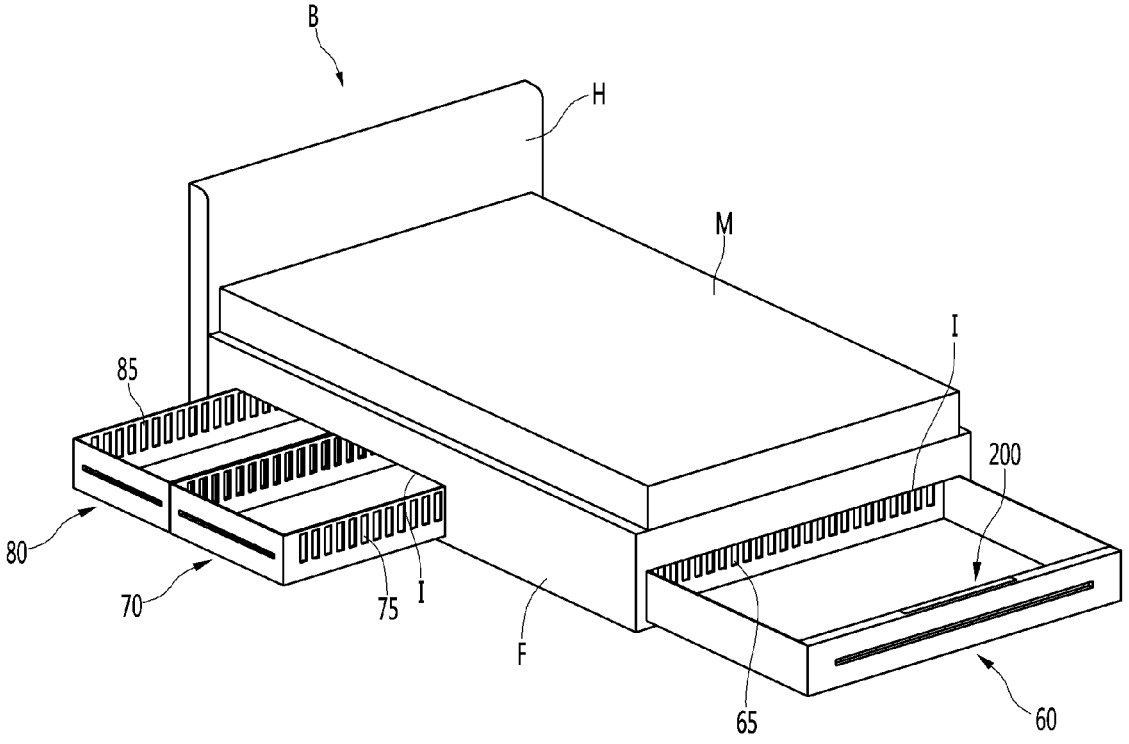
FIG. 2 is a perspective view showing an appearance of a bed with an opened drawer according to an embodiment of the present disclosure.
Figure 3:
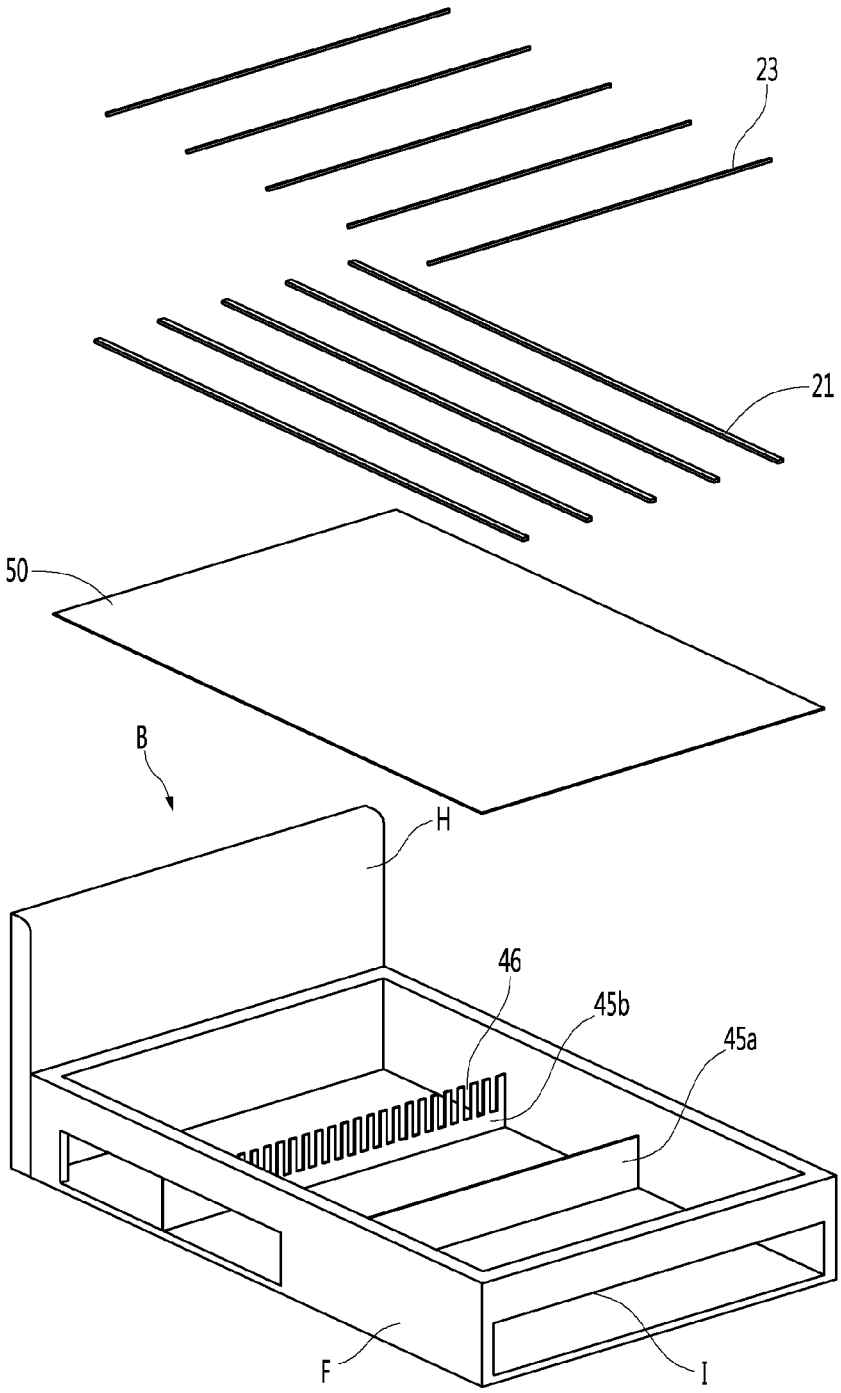
FIG. 3 is an exploded view showing a part of a configuration of a bed according to an embodiment of the present disclosure.

FIG. 1 is a perspective view showing a bed installed with a dryer according to an embodiment of the present disclosure, FIG. 2 is a perspective view showing an appearance of a bed with an opened drawer according to an embodiment of the present disclosure, and FIG. 3 is an exploded view showing a part of a configuration of a bed according to an embodiment of the present disclosure.

Referring to FIGS. 1 to 3, the dryer for a bed according to an embodiment of the present disclosure (hereinafter referred to as a "dryer") may be installed in the bed B. The bed B may include a frame F, a mattress M placed on the frame F, and a head portion H provided on an upper end of the frame F. The head portion H may extend to the upper side of the mattress M. The mattress M may have a rectangular parallelepiped shape having a predetermined vertical thickness.

The frame F may have a rectangular parallelepiped shape with an open upper portion, partitioning brackets 45*a* and 45*b* for partitioning an inner space of the frame F, which may be installed in the frame F. For example, the partitioning brackets 45*a* and 45*b* may extend in a transverse direction and the plurality of partitioning brackets 45*a* and 45*b* may be disposed to be spaced apart from each other in a front-rear direction.

For purposes of this disclosure, the following directions are defined. A part where the head portion H is positioned may be defined as a "front portion" of the bed B, and the opposite side may be defined as a "rear portion" of the bed B. Also between two positions, the position closer to the head portion H may be defined as a "front" and the position closer to the opposite side may be defined as a "rear".

The dryer may be provided at the front and rear of the frame F. For example, the dryer may include a first air blowing device 100 (see FIG. 4) and a second air blowing device 200. The first air blowing device 100 may be disposed at the front portion of the frame F, and the second air blowing device 200 may be disposed at the rear portion of the frame F. For example, the second air blowing device 200 may be disposed at a first drawer 60.

A flow path plate 50 may be provided in the frame F. The flow path plate 50 may be supported by the partitioning brackets 45*a* and 45*b* and may be fastened or attached to an inner surface of the frame F. An installation height of the flow path plate 50 may be lower than the upper end of the frame F.

The flow path plate 50 may function as part of a duct for guiding the flow of air generated in the first and second air blowing devices 100 and 200, and the air may flow through a space between the bottom of the mattress M and the flow path plate 50.

The bed B may be further provided with a plurality of support frames 21 and 23. The plurality of support frames 21 and 23 may be positioned above the frame F and arranged in a grid shape. The plurality of support frames 21 and 23 may support the mattress M.

Specifically, the plurality of support frames 21 and 23 may include a plurality of main support frames 21 disposed spaced apart from each other in the longitudinal direction extending in a front-to-rear direction and a plurality of sub-support frames 23 disposed spaced apart from each other in the transverse direction and extending in the side-to-side direction.

The plurality of sub-support frames 23 may be placed on an upper side of the plurality of main support frames 21. A thickness and strength of the main support frame 21 may be greater than a thickness and strength of the sub-support frame 23.

A plurality of drawers 60, 70, and 80 may be provided to be drawn out from the frame F. The plurality of drawers 60, 70, and 80 may be disposed in an inner space of the frame F partitioned by the partitioning brackets 45*a* and 45*b*.

The frame F may be formed with a drawer insertion portion I into which the plurality of drawers 60, 70, and 80 may be inserted. The drawer insertion portion I may be formed at each of rear and side surfaces of the frame F.

For example, the plurality of drawers 60, 70, and 80 may include a first drawer 60 provided to be drawn out from a rear portion of the frame F. The first drawer 60 may have a rectangular parallelepiped shape. The first drawer 60 may be provided to be drawn out backward, and a horizontal width of the first drawer 60 may be similar to a horizontal width of the frame F.

The first drawer 60 may be a drawer having a relatively large horizontal width in which a bulky bedding may be stored, for example.

The first drawer 60 may include a first flow path hole 65 through which air may pass. The first flow path hole 65 may be a hole for communication between an inner space and an outer space of the first drawer 60. For example, the first flow path hole 65 may be formed at a front portion of the first drawer 60.

The plurality of drawers 60, 70, and 80 may include second and third drawers 70 and 80 provided to be drawn out at the side portions of the frame F. The second and third drawers 70 and 80 may have a rectangular parallelepiped shape and having an open upper portion. The second and third drawers 70 and 80 may be provided to be drawn out laterally, and the third drawer 65 may be disposed in front of the second drawer 70.

The second and third drawers 70 and 80 may be drawers having a relatively small front-rear width in which clothing, having a small volume, may be stored, for example.

The second drawer 70 includes a second flow path hole 75 through which air may pass. The second flow path hole 75 may be a hole for communication between an inner space and an outer space of the second drawer 70. For example, the second flow path hole 75 may be formed at front and rear portions of the second drawer 70.

The third drawer 80 may have a third flow path hole 85 through which air may pass. The third flow path 85 may be a hole for communication between an inner space and an outer space of the third drawer 80. For example, the third flow path hole 85 may be formed at front and rear portions of the third drawer 70.

The partitioning brackets 45*a* and 45*b* may include a first bracket 45*a* partitioning an installation space of the first drawer 60 (hereinafter, referred to as a "first installation space") and an installation space of the second and third drawers 70 and 80 (hereinafter, referred to as a "second installation space") and a second bracket 45*b* partitioning an installation space of the second drawer 70 and an installation space of the third drawer 80.

The first bracket 45*a* and the second bracket 45*b* may extend in the transverse direction from one side of the frame F toward the other side. In addition, the first installation space and the second installation space may be separated by the first bracket 45*a* and may not communicate with each other.

The second bracket 45*b* may be disposed between the second and third drawers 70 and 80. A bracket hole 46 may be formed at the second bracket 45*b*. The bracket hole 46 may be aligned with the second flow path hole 75 of the second drawer 70 and the third flow path hole 85 of the third drawer 80. Therefore, the inner spaces of the second and third drawers 70 and 80 may communicate with each other through the bracket hole 46 and the second and third flow path holes 75 and 85.

Figure 4:
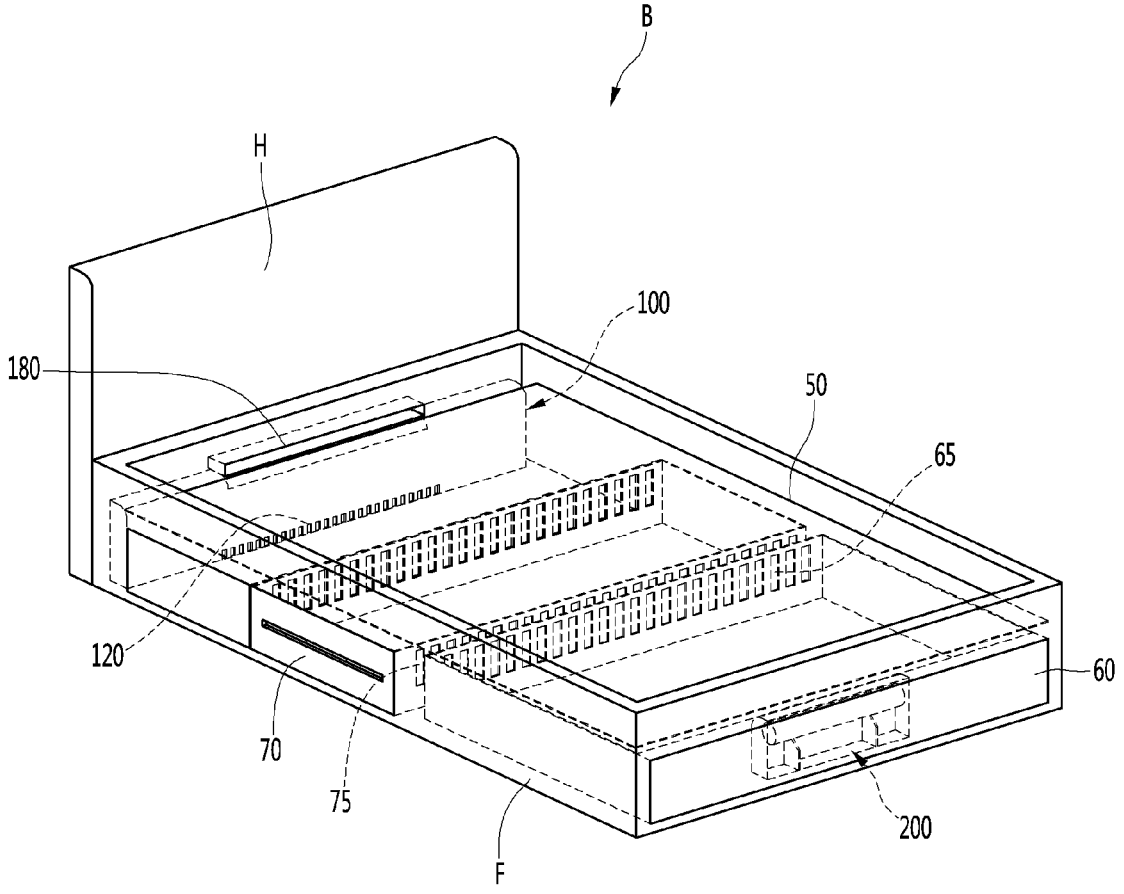
FIG. 4 is a transparent view showing a state where an air blowing device is installed at front and rear portions of a bed according to an embodiment of the present disclosure.
Figure 5:
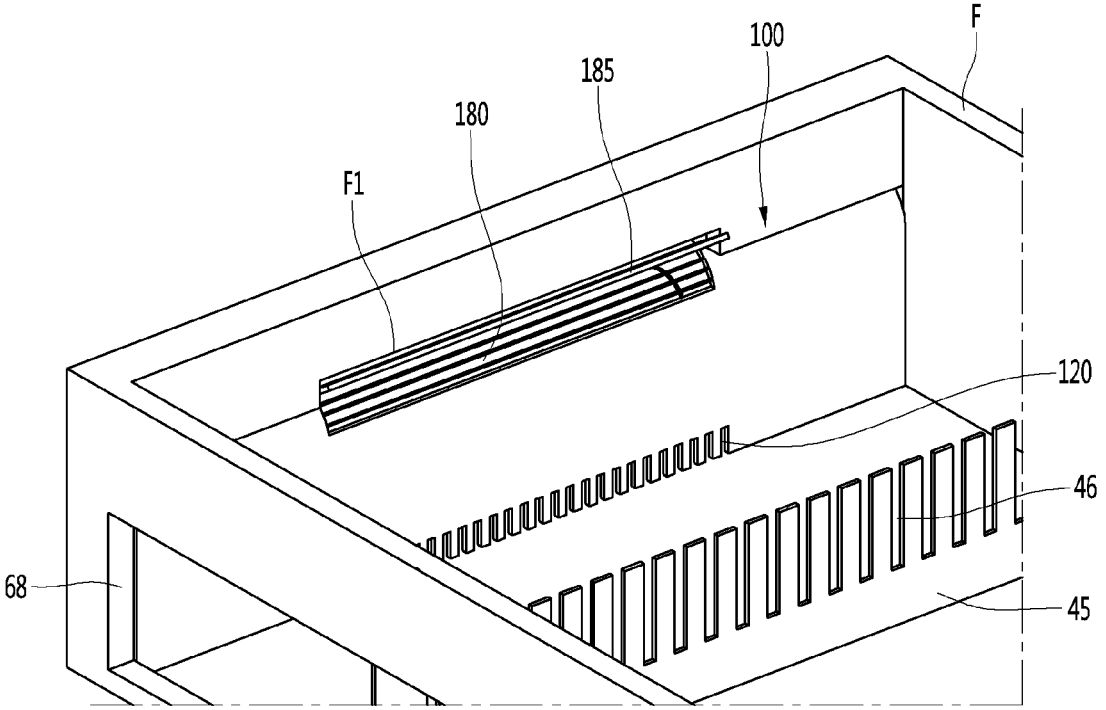
FIG. 5 is an enlarged view showing a state where a first air blowing device is installed at a frame of a bed according to an embodiment of the present disclosure.
Figure 6:
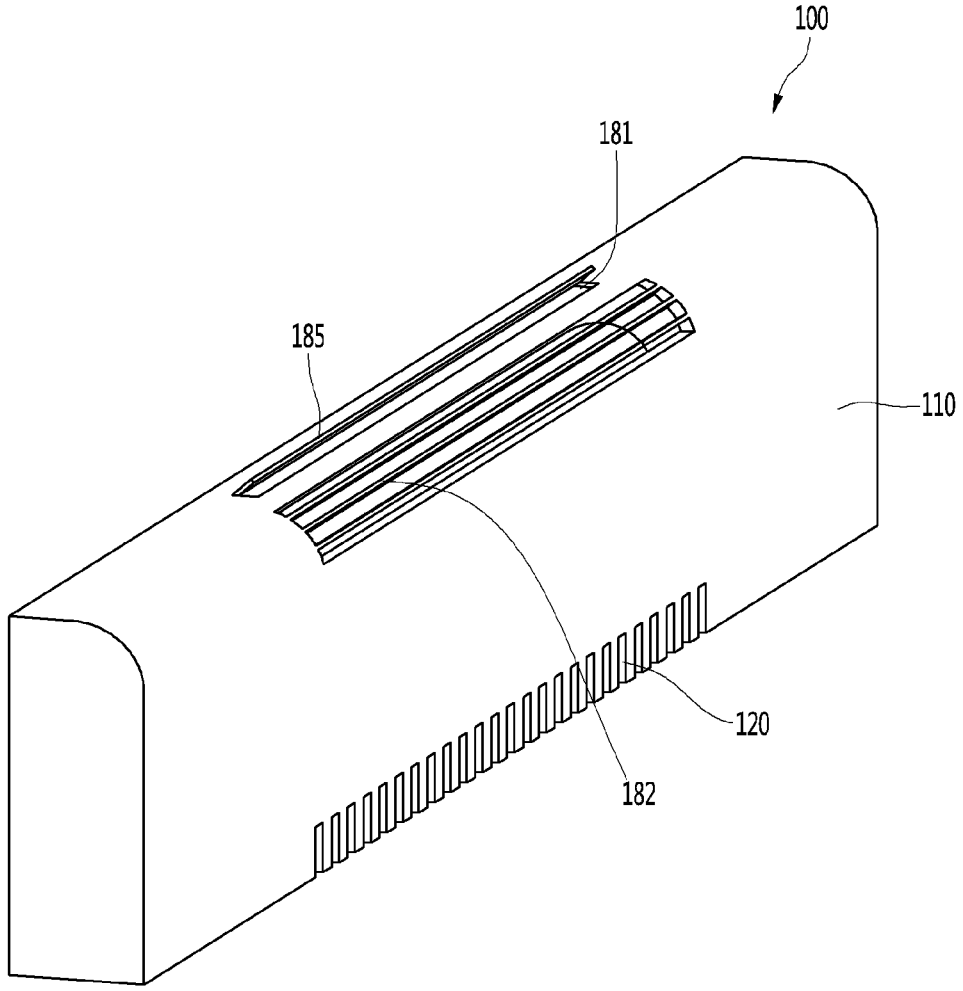
FIG. 6 is a perspective view showing a configuration of a front portion of the first air blowing device according to an embodiment of the present disclosure.
Figure 7:
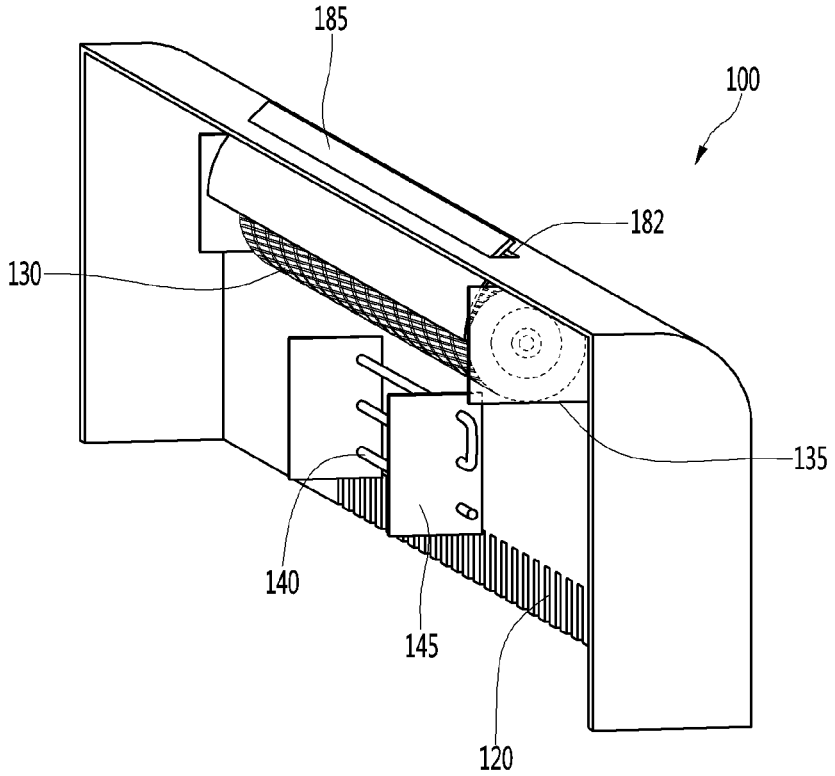
FIG. 7 is a perspective view showing a configuration of a rear portion of the first air blowing device according to an embodiment of the present disclosure.

FIG. 4 is a transparent view showing a state where an air blowing device is installed at front and rear portions of a bed according to an embodiment of the present disclosure, FIG. 5 is an enlarged view showing a state where a first air blowing device is installed at a frame of a bed according to an embodiment of the present disclosure, FIG. 6 is a perspective view showing a configuration of a front portion of the first air blowing device according to an embodiment of the present disclosure, and FIG. 7 is a perspective view showing a configuration of a rear portion of the first air blowing device according to an embodiment of the present disclosure.

Referring to FIGS. 4 to 7, the first and second air blowing devices 100 and 200 according to an embodiment of the present disclosure may be disposed at the front and rear portions of the bed B, respectively.

For example, the first air blowing device 100 may be installed at an inner surface of the front portion of the frame F. The first air blowing device 100 may include a first fan 130 for generating air flow and a first heater 140 installed at one side of the first fan 130 to heat air.

The first fan 130 may be a centrifugal fan including a cross-flow fan and the like, that intakes air in a circumferential direction and discharges the air in the circumferential direction. The first fan 130 may be disposed to rotate in a clockwise or counterclockwise direction with reference to a horizontal axial line.

A frame depressed portion F1 may be formed at the front portion of the frame F to form an installation space in which the first fan 130 and the heater 140 may be installed. The frame depressed portion F1 may be depressed forward from an inner side of the front portion of the frame F.

The first air blowing device 100 may further include a first air blowing body 110 covering rear portions of the first fan 130 and the first heater 140. The first fan 130 may be mounted in the first blowing body 110 through a first fan support portion 135. The first fan support portion 135 may be provided on both sides of the first fan 130 and may be coupled to an inner surface of the first air blowing body 110.

The first heater 140 may be mounted at the first blowing body 110 through a first heater bracket 145. The heater 140 may be a bent pipe, and both sides of the pipe may be supported by two first heater brackets 145.

The first heater 140 may be disposed on a suction side of the first fan 130, and air heated through the first heater 140 may flow upward and may be taken into the first fan 130.

The first air blowing body 110 may be formed with an air inlet 120 to which air flows in. The air inlet 120 may be formed at a lower portion of the first air blowing body 110 and may include a plurality of slits.

The first air blowing body 110 may include an air outlet 180 through which air passing through the first fan 130 is discharged. The air outlet 180 may include a first outlet portion 181 disposed above the first fan 130 and a second outlet portion 182 disposed above a rear side of the center of the first fan 130. The first and second outlet portions 181 and 182 may be formed on the first air blowing body 110. The second outlet portion 182 may include a plurality of grills extending in the transverse direction.

The second outlet portion 182 may be formed on the rear side with respect to the first outlet portion 181. When the first fan 130 is driven, air flow may be generated in a clockwise direction with respect to the center of the first fan 130 (see FIG. 12), and the air flow may be generated in a direction toward the second outlet portion 182 after passing through the first outlet portion 181.

The first air blowing device 100 may further include a first flow guide 150 (see FIG. 12) for guiding air flow through the first fan 130. The first flow guide 150 may be coupled to the first blowing body 110. For example, the first flow guide 150 may be coupled to an upper portion of the first blowing body 110 and may extend downward, and may extend curvedly along an outer circumferential surface of the first fan 130.

The first air blowing device 100 may further include an outlet vane 185 movably provided to open or close the first outlet portion 181. The outlet vane 185 may be hinged to the first outlet portion 181, and one side of the outlet vane 185 may rotate around the other side.

When the outlet vane 185 is operated to open the first outlet portion 181, the air passing through the first fan 130 may flow upward and may be discharged to the rear side through the first outlet portion 181. Meanwhile, when the outlet vane 185 operates to close the first outlet portion 181, the air passing through the first fan 130 may flow upward and may be discharged to the rear side through the second outlet portion 182.

Figure 8:
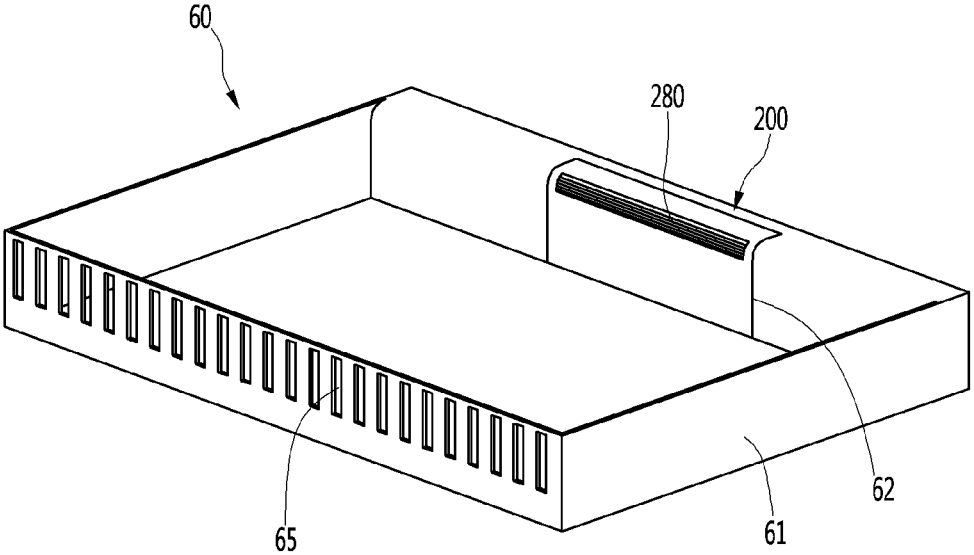
FIG. 8 is a perspective view showing a state where a second air blowing device is installed at a first drawer according to an embodiment of the present disclosure.
Figure 9:
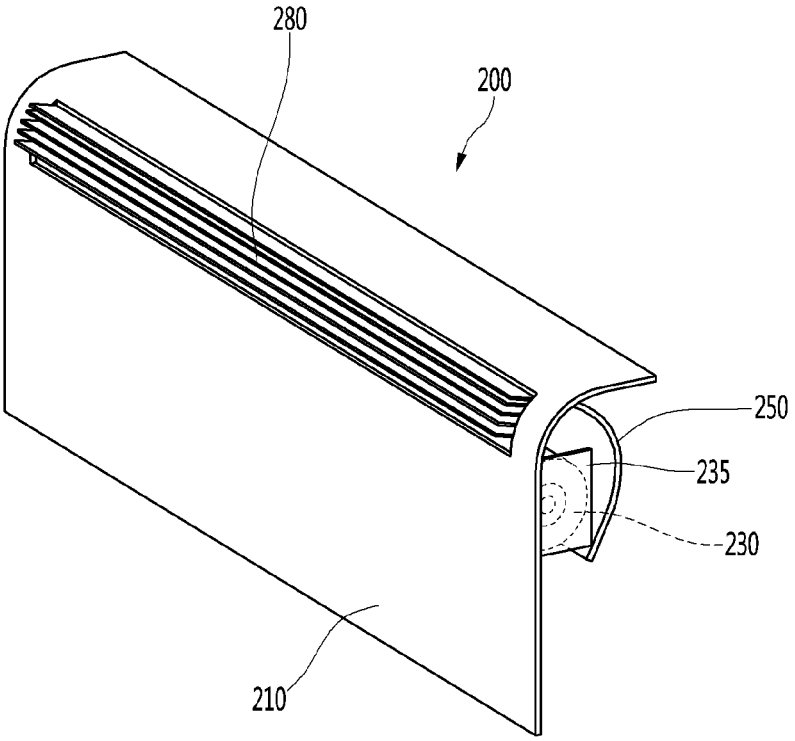
FIG. 9 is a perspective view showing a configuration of a front portion of the second air blowing device according to an embodiment of the present disclosure.
Figure 10:
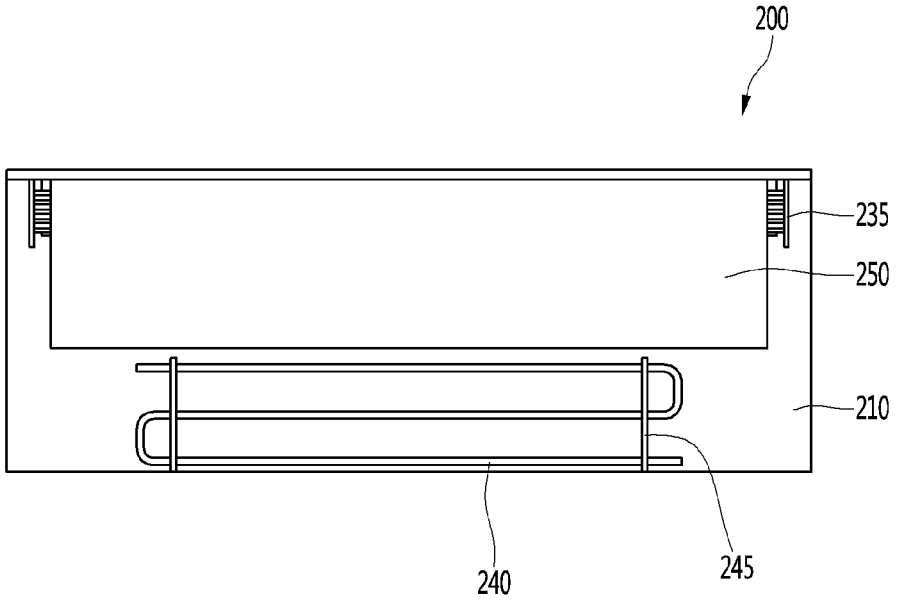
FIG. 10 is a plan view showing a configuration of a rear portion of the second air blowing device according to an embodiment of the present disclosure.

FIG. 8 is a perspective view showing a state where a second air blowing device is installed at a first drawer according to an embodiment of the present disclosure, FIG. 9 is a perspective view showing a configuration of a front portion of the second air blowing device according to an embodiment of the present disclosure, and FIG. 10 is a plan view showing a configuration of a rear portion of the second air blowing device according to an embodiment of the present disclosure.

Referring to FIGS. 8 to 10, a second air blowing device 200 according to an embodiment of the present disclosure may be installed at a rear portion of the first drawer 60. The second air blowing device 200 may include a second fan 230 for generating air flow and a second heater 240 installed at one side of the second fan 230 for heating air.

The second fan 230 may be a centrifugal fan including a cross-flow fan and the like that intakes air in a circumferential direction and discharges the air in the circumferential direction. The second fan 230 may be disposed to rotate in a clockwise or counterclockwise direction with reference to a horizontal axial line.

A drawer depressed portion 62 may be formed at a rear portion of the first drawer 60 to form an installation space in which the second fan 230 and the second heater 240 may be installed. The drawer depressed portion 62 may be depressed backward from an inner surface of the rear portion of the first drawer 60.

The second air blowing device 100 may further include a second air blowing body 210 covering rear portions of the second fan 230 and the second heater 240. The second air blowing body 210 may be coplanar with an inner surface of the rear portion of the first drawer 60.

A lower end of the second air blowing body 210 may be opened. An inlet flow path 330*a* (see FIG. 18) may be formed between the bottom of the frame F and the open lower end of the second air blowing body 210 so that air may be introduced to the second air blowing device 200.

The second fan 230 may be mounted at the second air blowing body 210 through a second fan support portion 235. The second fan support portion 235 may be provided on both sides of the second fan 230 and may be coupled to an inner surface of the second air blowing body 210.

The second heater 240 may be mounted at the second air blowing body 210 through a second heater bracket 245. The second heater 240 may be a bent pipe, and both sides of the pipe may be supported by two second heater brackets 245.

The second heater 240 may be disposed on a suction side of the second fan 230, and air heated through the second heater 240 may flow upward and may be taken into the second fan 230.

The second air blowing body 210 may include an air outlet 280 through which air passing through the second fan 230 may be discharged. The air outlet 280 may be formed on an upper portion of the second air blowing body 210. For example, the air outlet 280 may include a plurality of grills extending in a transverse direction.

For convenience of description, the air outlet 180 provided at the first air blowing device 100 may be referred to as a "first air outlet" and the air outlet 280 provided at the second air blowing device 200 may be referred to as a "second air outlet".

The second air blowing device 200 may further include a second flow guide 250 for guiding an air flow passing through the second fan 230. The second flow guide 250 may be coupled to the second air blowing body 210.

For example, the second flow guide 250 may be coupled to an upper portion of the first blowing body 110 to extend downward and may extend curvedly along an outer circumferential surface of the first fan 130. The second flow guide 250 may be provided in plurality at front and rear portions of the second fan 230.

Figure 11:
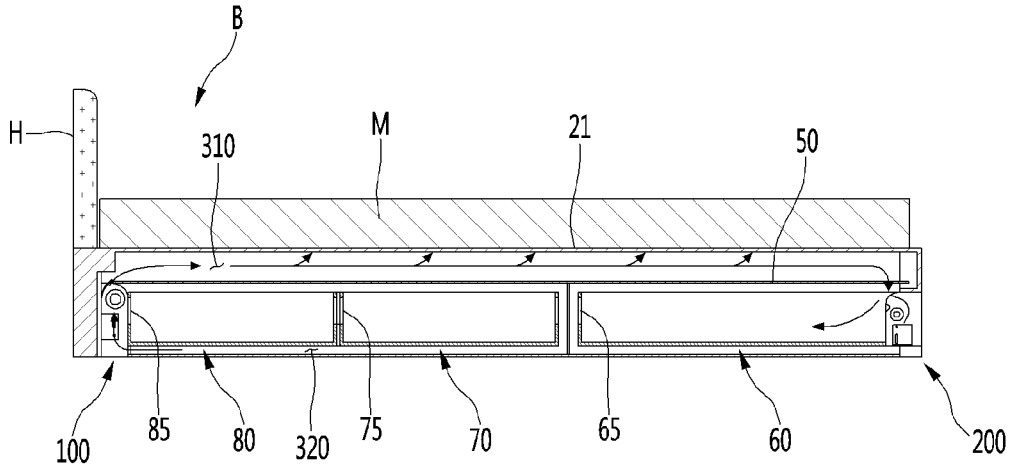
FIG. 11 is a cross-sectional view taken along line XI-XI' of FIG. 1.
Figure 12:
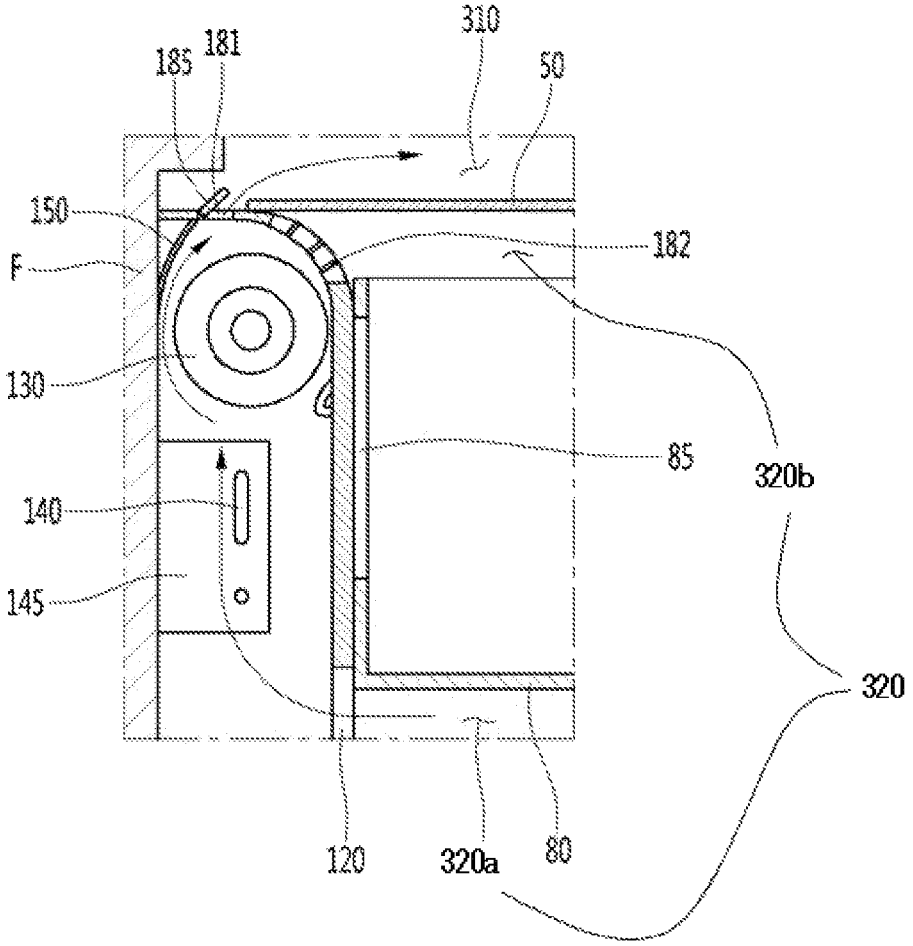
FIG. 12 is a cross-sectional view showing an air flow in the vicinity of a first air blowing device according to an embodiment of the present disclosure.
Figure 13:
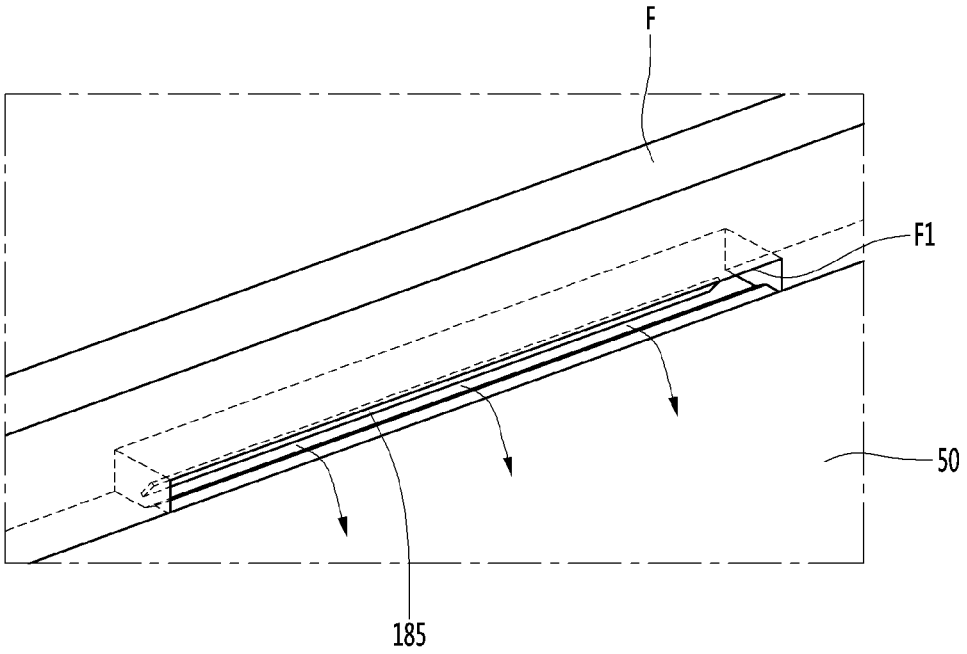
FIG. 13 is a transparent view showing a state where air discharged from the first air blowing device flows to an upper side of a support plate according to an embodiment of the present disclosure.
Figure 14:
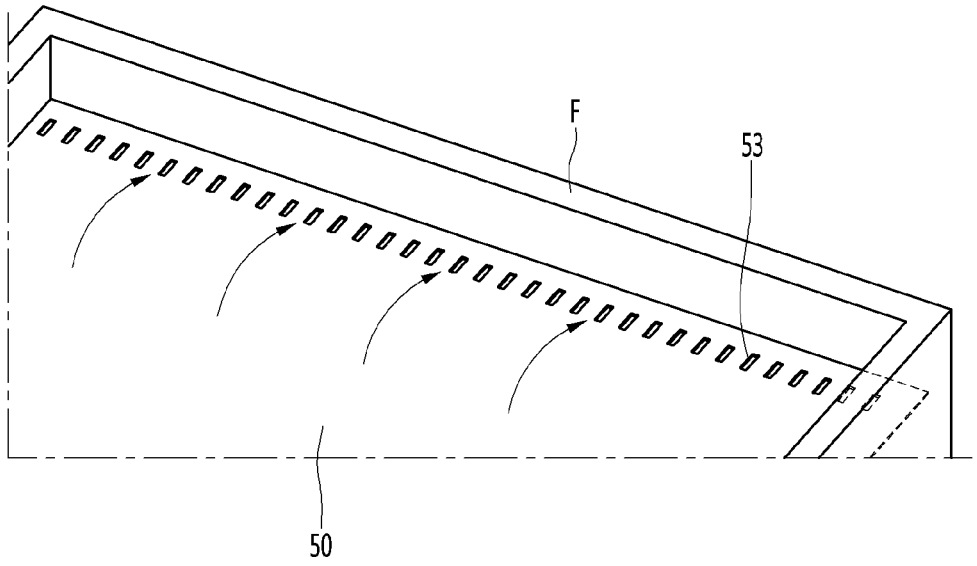
FIG. 14 is a perspective view showing a state where air flows downward from an upper side of a support plate according to an embodiment of the present disclosure.

FIG. 11 is a cross-sectional view taken along line XI-XI' of FIG. 1, FIG. 12 is a cross-sectional view showing an air flow in the vicinity of a first air blowing device according to an embodiment of the present disclosure, FIG. 13 is a transparent view showing a state where air discharged from the first air blowing device flows to an upper side of a support plate according to an embodiment of the present disclosure, and FIG. 14 is a perspective view showing a state where air flows downward from an upper side of a support plate according to an embodiment of the present disclosure.

Referring to FIGS. 11 to 14, the first air blowing device 100 according to an embodiment of the present disclosure may allow for generation and circulation of hot air for drying the mattress M.

For example, when the first fan 130 of the first air blowing device 100 is driven and the first heater 140 is driven, air may be taken into the first air blowing body 110 through the air inlet 120, may flow upward, and may be heated, while passing through the first heater 140. The heated air, that is, hot air, may pass through the first fan 130. The first fan 130 may rotate in a clockwise direction with reference to FIG. 12.

Here, an output power of the first heater 140 may be formed to be relatively high and may be driven so that a temperature of heated air is about 55° C. to 60° C., for example. That is, hot air may be generated and the hot air may be sufficient to eradicate even ticks if they were to inhabit the mattress M.

A blowing strength of the first fan 130 may be formed relatively strong to facilitate supply of hot air to the mattress M.

The outlet vane 185 may operate to open the first outlet portion 181. For example, a rear portion of the outlet vane 185 may rotate centered on a front portion thereof to open the first outlet portion 181. Therefore, the air passing through the first fan 130 may be discharged to the outside of the first air blowing device 100 through the opened first outlet portion 181.

Since the first outlet portion 181 is positioned on an upstream side of the second outlet portion 182 with respect to the air flow, air passing through the first fan 130 may be mostly discharged through the first outlet portion 181 and air discharged through the second outlet portion 182 may be relatively small or little.

The air discharged from the first air blowing device 100 may flow through a mattress drying flow path 310. The mattress drying flow path 310 may be a flow path formed between the bottom of the mattress M and an upper surface of the flow path plate 50.

The mattress drying flow path 310 may be formed at the upper side of the first air blowing device 100 and the upper side of the first to third drawers 60, 70, and 80. The mattress drying flow path 310 may be extend in a front-rear direction along the bottom of the mattress M.

Hot air in the mattress drying flow path 310 may flow through the bottom of the mattress M to dry the mattress M. Part of the hot air may flow to the rear portion of the frame F and may flow into the first drawer 60 through a plate penetrating portion 53 of the flow path plate 50. The plate penetrating portion 53 may be formed at a rear portion of the flow path plate 50 and may include, for example, a plurality of holes aligned in the transverse direction.

Meanwhile, since the inner space of the first drawer 60 communicates with the outside of the first drawer 60 through the first flow path hole 65, the hot air may easily flow to the inside of the first drawer 60.

A first drawer flow path 320 may be formed outside the second and third drawers 70 and 80. For example, the first drawer flow path 320 may include an inlet flow path **320*a* formed in a space between the bottoms of the second and third drawers 70 and 80 and a lower end of the frame F and an outlet flow path 320*b* may be formed in a space between upper portions of the second and third drawers 70 and 80 and the bottom of the flow path plate 50**.

When the first fan 130 is driven, air present in the first drawer flow path 320 may flow to the inside of the first blowing body 110 through the air inlet 120 and may pass through the first heater 140 and the first fan 130.

Figure 15:
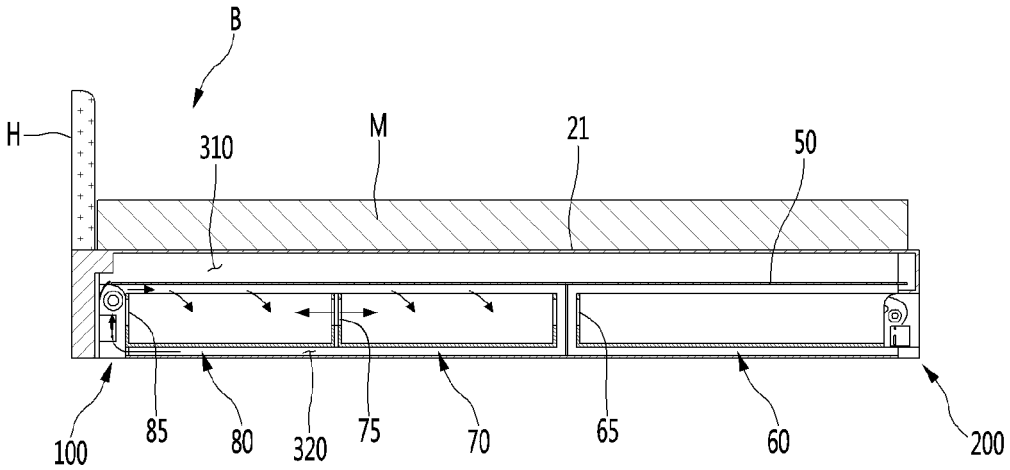
FIG. 15 is a cross-sectional view showing a flow of air when an outlet vane of the first air blowing device is closed according to an embodiment of the present disclosure.
Figure 16:
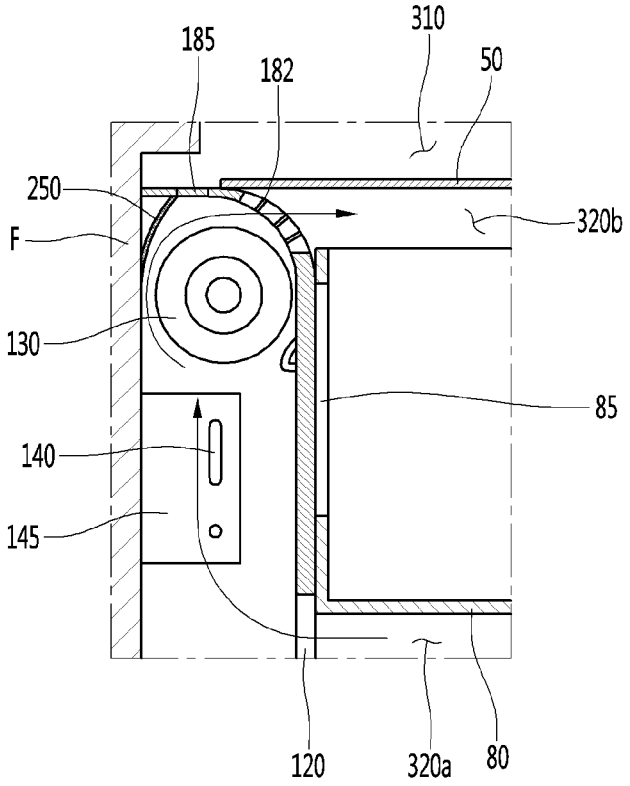
FIG. 16 is an enlarged cross-sectional view showing a state of an air flow in the vicinity of the first air blowing device when the outlet vane of the first air blowing device is closed according to an embodiment of the present disclosure.

FIG. 15 is a cross-sectional view showing a flow of air when an outlet vane of the first air blowing device is closed according to an embodiment of the present disclosure, and FIG. 16 is an enlarged cross-sectional view showing a state of an air flow in the vicinity of the first air blowing device when the outlet vane of the first air blowing device is closed according to an embodiment of the present disclosure.

Referring to FIGS. 15 and 16, when the outlet vane 185 of the first air blowing device 100 according to an embodiment of the present disclosure operates to close the first outlet portion 181, air passing through the first heater 140 and the first fan 130, that is, the hot air, may be discharged to the outlet flow path **320*b* through the second outlet portion 182**.

Here, the first heater 140 may be driven so that an output power thereof is lower than an output power of the first heater 140 when the mattress M is dried. For example, the first heater 140 may be driven so that a temperature of the heated air is about 40° C. to 45° C. That is, hot air may be generated, but the hot air may not be hot enough to damage the clothes stored in the second and third drawers 70 and 80, while drying the clothes.

The first fan 130 may be driven so that a blowing strength is lower than when drying the mattress M. Therefore, damage to the clothes may be prevented.

Air of the outlet flow path **320*b* flows into the inner space of the third drawer 80 and the inner space of the second drawer 70, and part of the air may flow to the inlet flow path 320*a* along an outer space of the second and third drawers 70 and 80**.

Since the second and third drawers 70 and 80 communicate with each other, air in the third drawer 80 may flow into the second drawer 70 and the air in the second drawer 70 may flow into the third drawer 80.

The clothes stored in the second and third drawers 70 and 80 may be dried by the hot air supplied into the second and third drawers 70 and 80, thereby preventing propagation of germs, for example.

Meanwhile, the air circulated through the second and third drawers 70 and 80 may flow again into the first air blowing device 100 through the air inlet 120 from the inlet flow path **320*a* on the lower side of the second and third drawers 70 and 80**.

Figure 17:
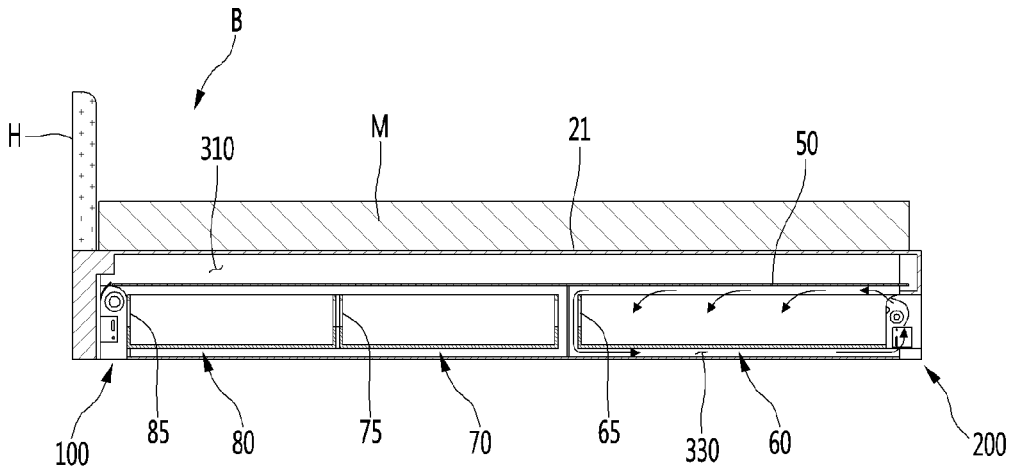
FIG. 17 is a cross-sectional view showing a flow of air circulating in a second air blowing device according to an embodiment of the present disclosure.
Figure 18:
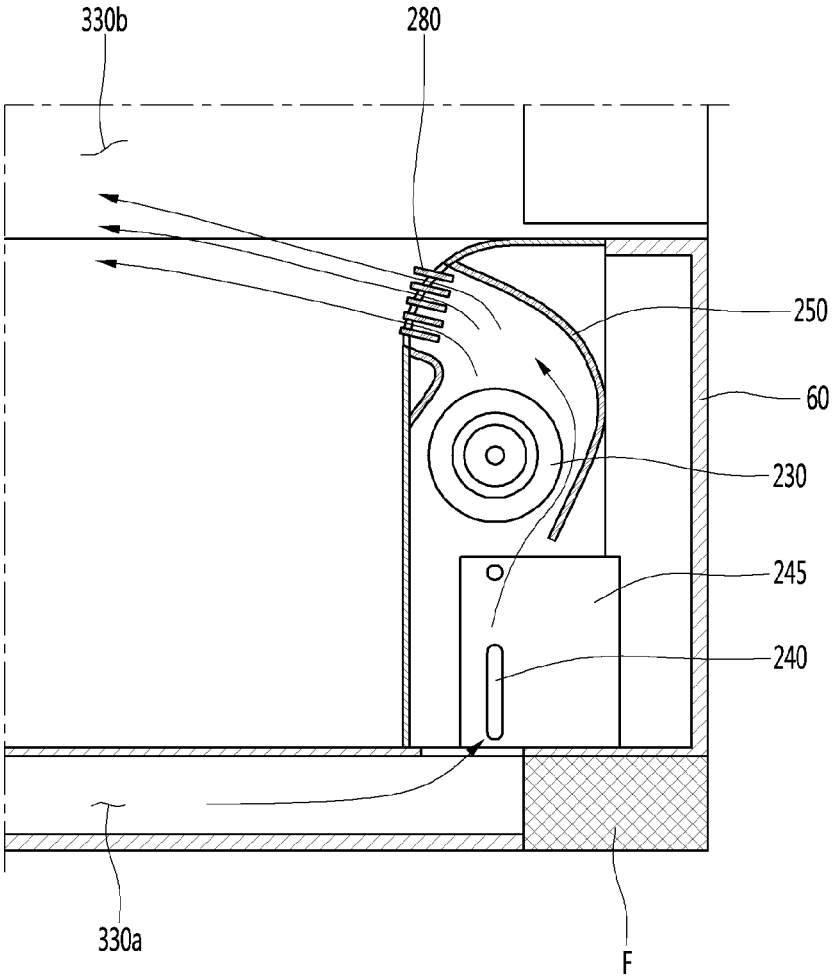
FIG. 18 is an enlarged cross-sectional view showing a state of an air flow in the vicinity of the second air blowing device according to an embodiment of the present disclosure.

FIG. 17 is a cross-sectional view showing a flow of air circulating in a second air blowing device according to an embodiment of the present disclosure, and FIG. 18 is an enlarged cross-sectional view showing a state of an air flow in the vicinity of the second air blowing device according to an embodiment of the present disclosure.

Referring to FIGS. 17 and 18, when the second air blowing device 200 according to an embodiment of the present disclosure is driven, bedding stored in the first drawer 60 may be dried.

A second drawer flow path 330 may be formed outside the first drawer 60. For example, the second drawer flow path 330 may include an inflow flow path 330*a* formed in a space between the bottom of the first drawer 60 and the lower end of the frame F and an outlet flow path 330*b* formed in a space between an upper portion of the first drawer 60 and the bottom of the flow path plate 50.

When the second heater 240 and the second fan 230 of the second air blowing device 200 are driven, air passing through the second heater 240 and the second fan 230, that is, hot air, may be discharged forward through the air outlet 280 and may flow through the outflow flow path 330*b*.

Here, the second heater 240 may be driven so that a temperature of the heated air is lower than that when drying the mattress M. For example, the second heater 240 may be driven so that the temperature of the heated air is about 40° C. to 45° C. That is, hot air may be generated, but the hot air may not be hot enough to damage the bedding stored in the first drawer 60, while drying the bedding.

Also, the second fan 230 may be driven so that a blowing strength is lower than that when drying the mattress M. Therefore, damage to the bedding may be prevented.

The air of the outflow flow path 330*b* may flow into the inner space of the first drawer 60, and part of the air may flow to the inlet flow path 330*a* along the outer space of the first drawer 60.

The bedding stored in the first drawer 60 may be dried by the hot air supplied into the first drawer 60, thereby preventing propagation of bacteria, for example.

Meanwhile, the air circulated through the first drawer 60 may flow into the second air blowing device 200 through the open lower end of the second air blowing device 200 from the inlet flow path 330*a* on the lower side of the first drawer 60.

According to the dryer for a bed according to an embodiment of the present disclosure, propagation of germs, molds or dust mites may be prevented by performing drying on a mattress.

Air may be easily circulated through the first air blowing device provided at the frame of the bed. In particular, warm air may be supplied to the bottom of a mattress and part of air may be discharged to a lower space of the mattress by driving the first air blowing device.

Air may be easily circulated through the second air blowing device provided at a drawer provided in the bed. In particular, warm air may be supplied to an inside of the drawer and the circulation flow path of air may be formed outside the drawer according to driving of the second air blowing device.

The fan and the heater of the first air blowing device or the second air blowing device may be modularized to implement a device for supplying warm air to have a compact structure The air blowing device may include the outlet vane and the outlet vane controls ON/OFF to change a circulation flow path of warm air, thereby selectively drying the mattress or an article kept in the drawer.

The drawers may have the flow path holes so that warm air may be circulated between the adjacent drawers.

It will be apparent to those skilled in the art that various modifications and variations may be made in the present disclosure without departing from the spirit or scope of the disclosures. Thus, it is intended that the appended claims and their equivalents cover the modifications and variations of this disclosure.

What is claimed is:

1. A bed comprising:

a frame including a flow path plate on which a mattress is placed on the frame;

a drawer provided to be drawn into or out of the frame, a first air blowing device disposed at the frame, the first air blowing device including:

a first air blowing body including a first fan and a first heater, the first air blowing body being coupled to a surface of the front portion of the frame;

a first air inlet formed at a lower portion of the first air blowing body; and a first air outlet formed at an upper portion of the first air blowing body, a second air blowing device disposed at the drawer, the second air blowing device including:

a second air blowing body coupled to a surface of the drawer and including a second fan and a second heater; and a second air outlet formed at an upper portion of the second air blowing body; and a mattress drying flow path formed between a bottom of the mattress and the flow path plate to allow air which passes through the first fan to flow therethrough.

2. The bed of claim 1, comprising a partitioning bracket disposed in the frame to partition an installation space of the frame, and the flow path plate is supported on an upper side of the partitioning bracket.

3. The bed of claim 1, wherein the frame includes a frame depressed portion forming a space at the surface of the front portion of the frame in which the fan and the heater are disposed, and the first air blowing body covers the frame depressed portion.

4. The bed of claim 1, wherein the first air outlet comprises:

a first outlet portion disposed at an upper side of the fan; and a second outlet portion disposed at a rear of the first outlet portion.

5. The bed of claim 4, wherein the first outlet portion and the mattress drying flow path communicate with each other.

6. The bed of claim 5, comprising an outlet vane coupled to the first outlet portion, the outlet vane to open and close the first outlet portion.

7. The bed of claim 6, further comprising:

a controller configured to drive the first heater such that an output power of the first heater when the first air blowing device operates the outlet vane to open the first outlet portion is greater than an output power of the first heater when the first air blowing device operates the outlet vane to close the first outlet portion.

8. The bed of claim 4, wherein a drawer flow path is formed at a space at an upper side of the drawer that communicates with the second outlet portion when the drawer is drawn into the frame.

9. The bed of claim 1, wherein a drawer flow path is formed at a space below a bottom side of the drawer that communicates with the first air inlet when the drawer is drawn into the frame.

10. The bed of claim 1, wherein the drawer includes a drawer depressed portion forming a space at a surface of the drawer in which the second fan and the second heater are disposed, and the second air blowing body covers the drawer depressed portion.

11. The bed of claim 1 wherein the flow path plate includes a plate penetrating portion, and at least a portion of the air flowing in the mattress drying flow path flows to a lower side of the flow path plate through the plate penetrating portion into the drawer.

12. A dryer for a bed, the bed including a frame having a flow path plate, a mattress placed on the frame and a drawer located vertically below the mattress and provided to be drawn into or out of the frame, the dryer comprising:

an air blowing device disposed at least one of a front portion and a rear portion of the frame, the air blowing device to allow air which passes through the air blowing device to flow through the mattress and the drawer, wherein the air blowing device comprises:

a fan and a heater;

a partially enclosed air blowing body including a portion configured to be round in a circumferential direction of the fan to shield the heater and the fan and a first outlet portion formed in the portion and a second outlet formed in the portion and disposed adjacent to the first portion;

a mattress drying flow path formed between a bottom of the mattress and the flow path plate; and a drawer flow path formed between the flow path plate and the drawer, wherein the flow path plate being configured to separate the drawer flow path from the mattress drying flow path, wherein the first outlet portion fluidly communicates with the mattress drying flow path and the second outlet portion fluidly communicates with the drawer flow path.

13. The dryer of claim 12, wherein the first outlet portion is disposed at an upper side of the fan; and the second outlet portion is disposed at a rear of the first outlet portion.

14. The dryer of claim 13, further comprising an outlet vane coupled to the first outlet portion, the outlet vane to open and close the first outlet portion.

15. The dryer of claim 14, further comprising:

a controller configured to drive the heater such that an output power of the heater when the air blowing device operates the outlet vane to open the first outlet portion is greater than an output power of the heater when the air blowing device operates the outlet vane to close the first outlet portion.

16. The dryer of claim 12, wherein the air blowing device comprises a flow guide coupled to an inner surface of the air blowing body and extending curvedly to an outer side of the fan.

17. The dryer of claim 12, comprising:

a heater bracket disposed at the air blowing body and supporting the heater, wherein the fan includes a centrifugal fan disposed at an upper side of the heater bracket to discharge the air taken in through the air blowing body to the air outlet.

18. A dryer for a bed, the bed including a frame having a flow path plate, a mattress placed on the frame and a drawer located vertically below the mattress and provided to be drawn into or out of the frame, the dryer comprising:

an air blowing device disposed at the frame and comprising:

a fan and a heater;

an air blowing body configured to shield the heater and the fan and including a first outlet portion and a second outlet disposed adjacent to the first portion;

a mattress drying flow path formed between a bottom of the mattress and the flow path plate; and a drawer flow path formed between the flow path plate and the drawer, wherein the flow path plate being configured to separate the drawer flow path from the mattress drying flow path; and an outlet vane provided at the first outlet, the outlet vane being configured to open or close the outlet and to adjust amount of the air flowing into the mattress drying flow path and the drawer flow path, and wherein the outlet vane is configured to operate such that:

when the outlet vane opens the first outlet portion, a first amount of the air introduced into the mattress drying flow path through the first outlet portion is greater than a second amount of the air introduced into the drawer flow path through the second outlet portion, and when the outlet vane closes the first outlet portion, the air is introduced into the drawer flow path through the second outlet portion.

* * * * *